United States Patent [19]

Pantucek

[11] Patent Number: 4,976,427

[45] Date of Patent: Dec. 11, 1990

[54] FRICTIONAL EXERCISER WITH TEMPERATURE INDICATING STRUCTURE

[76] Inventor: Anton Pantucek, Simmeringer Hauptstrasse 113/12, 1110 Wien, Austria

[21] Appl. No.: 254,930

[22] PCT Filed: Jan. 29, 1987

[86] PCT No.: PCT/EP87/00040

§ 371 Date: Aug. 18, 1988

§ 102(e) Date: Aug. 18, 1988

[87] PCT Pub. No.: WO87/04937

PCT Pub. Date: Aug. 27, 1987

[30] Foreign Application Priority Data

Feb. 20, 1986 [DE] Fed. Rep. of Germany ..... 3605504
Feb. 24, 1986 [AT] Austria ..... 465/86

[51] Int. Cl.[5] ..... A63B 21/012
[52] U.S. Cl. ..... 272/131; 272/DIG. 5
[58] Field of Search ..... 272/93, 116, 131, DIG. 5, 272/143, 67, 68, 123, 125, 132, 133

[56] References Cited

U.S. PATENT DOCUMENTS

| | | | |
|---|---|---|---|
| 3,637,205 | 1/1972 | Bankston | 272/68 |
| 3,811,672 | 5/1974 | Simmons | 272/67 X |
| 3,971,255 | 7/1976 | Varney et al. | 272/143 X |
| 4,251,071 | 2/1981 | Norton | 272/68 X |
| 4,563,004 | 1/1986 | Mattox | 272/131 |
| 4,591,150 | 5/1986 | Mosher | 272/143 X |
| 4,665,388 | 5/1987 | Ivie | 272/DIG. 5 X |

FOREIGN PATENT DOCUMENTS

| | | | |
|---|---|---|---|
| 1061375 | 8/1979 | Canada | 272/93 |
| 1108199 | 4/1968 | United Kingdom . | |

*Primary Examiner*—Robert Bahr
*Attorney, Agent, or Firm*—Oblon, Spivak, McClelland, Maier & Neustadt

[57] ABSTRACT

An exerciser in the form of a rod and a T-piece attached on one end of the rod with non-skid padded legs. The T-piece serves to brace or fix the rod while the rod is grasped by the user and has friction applied to it for exercise. By a temperature display, the user receives information on the amount of frictional heat generated by the application of friction and thus on his or her training performance.

8 Claims, 2 Drawing Sheets

FRICTIONAL EXERCISER WITH TEMPERATURE INDICATING STRUCTURE

FIELD OF THE INVENTION

The invention relates to an exerciser with a rod along which, with frictional engagement, a back-and-forth motion can be conducted.

BACKGROUND OF THE INVENTION

In a device of this type known from DE-OS 30 32 255, a carriage that is provided with a handle and friction pads is guided slidable on the rod. The rod is fastened to a bottom plate, on which the user is the stand. Such a device is relatively complicated in its construction and also in its use.

OBJECT OF THE INVENTION

The invention has as its object to provide an exerciser that is simpler to produce and to use than the known device; with which, despite this, a greater number of exercises can be performed; and with which the user can vary the load on the muscles at any point in the movement in any way.

SUMMARY OF THE INVENTION

The foregoing object is achieved in an surprisingly simple way in that the rod has, on one end, a rigid T-piece with nonskid, padded legs, and the back-and-forth motion can be performed by grasping the rod. With an exerciser according to the invention, training can be performed in that the rod can be grasped, for example by gloves, with any tightness, and a back-and-forth movement can be performed. Thus exactly those muscles, ligaments, and tendons are stressed that are to be trained. The tighter the rod is grasped, the greater becomes the friction, and thus the load on the parts of the body to be trained. This results in an ideal possibility for spontaneous load regulation and training maximization. The padded T-piece serves, in certain exercises, for bracing on the hips, on the floor, and on the wall, as well as for securing the rod between the legs, with the feet, or the like.

Although in the simplest case the rod can be grasped with gloves, it is also possible that certain friction sleeves of leather or of leatherlike materials can be slidably supported for grasping with the hands.

The frictional heat applied to the rod is a proportional parameter for the training performance produced. To be able to display this training performance in a simply way, it is advantageous if the rod is privided with a device that shows its temperature.

In a simple embodiment, the rod can be coated with a thermoindicator color. In this case, the frictional work which is applied to the rod and converted into heat and which is proportional to the training performance achieved is shown by a corresponding color change.

In another embodiment of the invention, there is placed in the rod a device that converts its linear expansion into an electric pulse, and the electric pulse actuates an optical and/or an acoustic display device.

DETAILED DESCRIPTION OF THE PRESENTLY PREFERRED EMBODIMENTS

Figure 1:
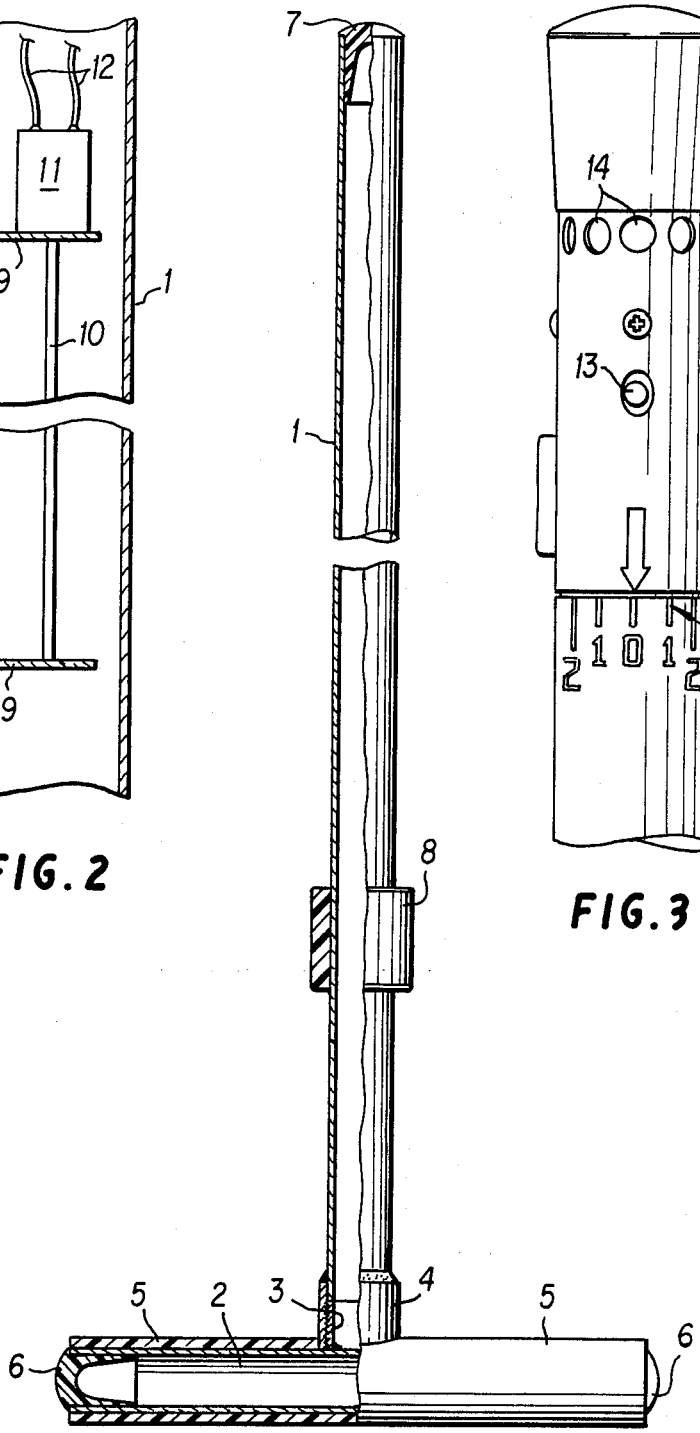
FIG. 1 shows an exerciser according to the invention half in section, half in view.

The exerciser shown in FIG. 1 comprises a rod 1 that is preferably tube-shaped, that is about 1.5 to 2 m long, and that is connected on one end rigidly to a T-piece 2. The connection occurs here by a nipple 3 on which a bushing 4 that is welded to the rod 1 is screwed. The legs of the T-piece 2 are provided with a padding 5, and caps 6 are inserted into the ends of the T-piece 2. Also, the end of the rod 1 is closed with a cap 7.

Figure 4:
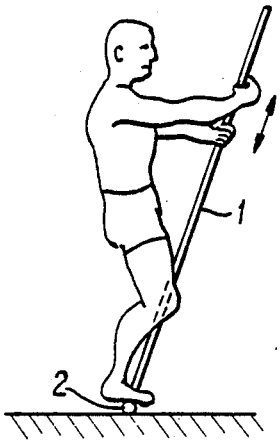
FIGS. 4 to 7 show possibilities of use of an exerciser according to the invention.

An exerciser according to the invention can, for example, be used according to FIG. 4 so that the user climbs onto the T-piece 2 and moves back and forth on it with hands grasping the rod 1. Here it is possible to don gloves, but friction sleeves of leather of leatherlike material to be grasped by the hands can be supported slidably on the rod. Such a friction sleeve 8 is indicated in FIG. 1.

Figure 5:
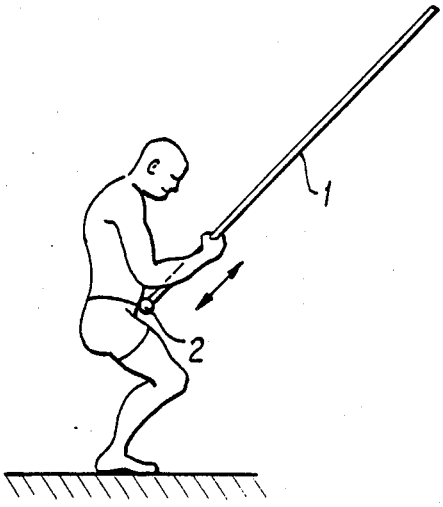

According to FIG. 5, for latissimus training, the T-piece is 2 is braced in the area of the abdomen.

Figure 6:
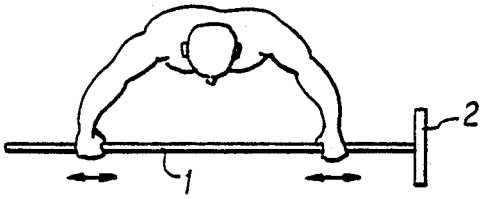

According to FIG. 6, for chest and back-muscle training, no bracing on the T-piece occurs.

Figure 7:
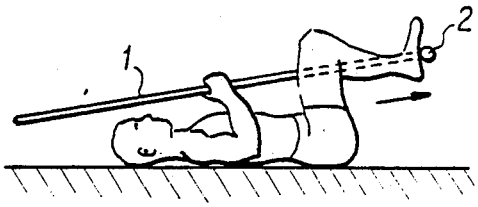

Training of the thigh and gluteal muscles can be performed according to FIG. 7 by bracing the legs on the T-piece 2 while lying down.

In all the shown applications of the exerciser according to the invention and in all further possible applications not shown, the user can vary the load on the muscles, ligaments, and tendons at any point in the movement in any way from zero up to the maximum without having to interrupt the movement. To do so, it is necessary simply that the rod be grasped more or less tightly. In this way, in any phase of the movement, training can take place at maximum load with highest efficiency. Despite this, injuries by overstressing are excluded. This is so because, with the slightest indication of pain, the grip of the hands can be released, and an immediate removal of the load can be produced.

As previously explained, the rod 1 can be provided with a device that displays its temperature. In the simplest case, this can be a thermometer, but it is also possible to coat the rod with a thermoindicating color.

Figure 2:
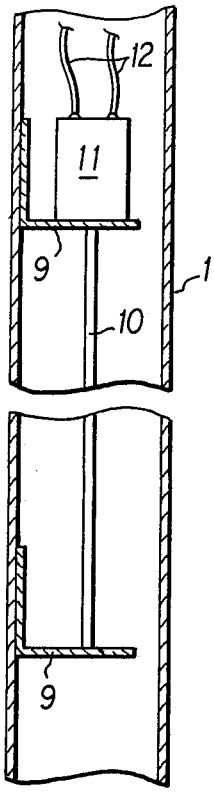
FIG. 2 shows diagrammatically a device that reacts to the thermal expansion of the rod.
Figure 3:
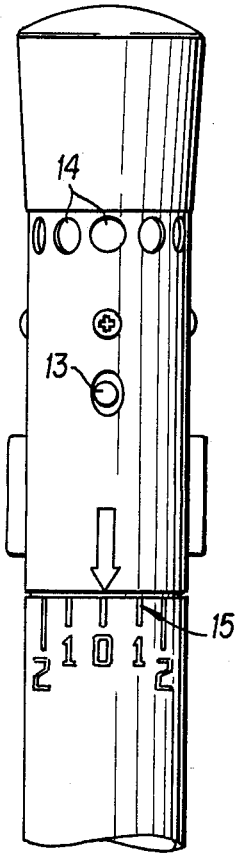
FIG. 3 shows the upper part of an exerciser with display and adjustment devices.

Another possibility is indicated in FIGS. 2 and 3. According to FIG. 2, inside the rod 1 there is supported by two brackets 9 a traction roller 10. One end of the traction roller 10 is held in an electric switch 11. From the electric switch 11, two electric lines 12 lead by way of batteries (not shown) to an optical signal 13 (FIG. 3).

With suitable use of the exerciser, the rod 1 is warmed by the frictional heat, so that it will expand. The warmth is practically not transferred to the traction roller 10. The two brackets 9 will thus move against each other, and electric switch 11 is actuated by the action roller 10. The circuit thus closed by the lines 12 causes the optical signal 13 to light up.

FIG. 3 represents further that the point at which the electric switch 11 responds can be adjusted by an adjustment device 15, so that the user has the possibility of causing the point at which the optical signal 13 lights up to depend on a desired degree of performance. A plurality of bores 14 are also represented in FIG. 3. An acoustic signal can be placed behind the bores 14.

I claim:

1. An exerciser comprising:

(a) arod having two ends;

(b) a T-piece mounted on one of said two ends of said rod, said T-piece having non-skid padded legs;

(c) a friction sleeve slidably mounted on said rod for reciprocal sliding motion on said rod when grasped by a user of the exerciser, which reciprocal sliding motion causes the temperature of said rod to increase; and (d) means carried by said rod and in direct physical contact with said rod for giving a distinct signal when the temperature of said rod due to said reciprocal sliding motion has increased by a predetermined amount, said means giving no signal until the temperature of said rod due to said reciprocal sliding motion has increased by the predetermined amount.

2. An exerciser as recited in claim 1 wherein said means comprises a costing of thermal indicating color on said rod.

3. An exerciser as recited in claim 1 wherein said means comprised an optical display.

4. An exerciser as recited in claim 1 wherein said means comprises an acoustic indicator.

5. An exerciser comprising:

(a) a rod having two ends;

(b) a T-piece mounted on one of said two ends of said rod, said T-piece having non-skid padded legs;

(c) a friction sleeve slidably mounted on said rod for recoprocal sliding motion on said rod when grasped by a user of the exerciser, which reciprocal sliding motion causes the temperature of said rod to increase; and (d) means carried by said rod and in direct physical contact with said rod for giving distinct signals corresponding to the temperature changes of said rod due to said reciprocal sliding motion, said means giving no signal until the temperature of said rod due to said reciprocal sliding motion has increased by a predetermined amount.

6. An exerciser as recited in claim 5 wherein said means comprises a coating of thermal indicating color on said rod.

7. An exerciser as recited in claim 5 wherein said means comprises an optical display.

8. An exerciser as recited in claim 5 wherein said means comprises an acoustic indicator.

* * * * *